US006783209B2

(12) United States Patent
Gompertz

(10) Patent No.: US 6,783,209 B2
(45) Date of Patent: Aug. 31, 2004

(54) MULTIPLE PRINT BAR APPROACH TO PEN HEALTH AND FIBER MANAGEMENT

(75) Inventor: Ronald S. Gompertz, Sant Cugat Dez Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/161,033

(22) Filed: Jun. 3, 2002

(65) Prior Publication Data

US 2003/0222939 A1 Dec. 4, 2003

(51) Int. Cl.[7] ..... B41J 2/21; B41J 2/165
(52) U.S. Cl. ..... 347/43; 347/14; 347/29
(58) Field of Search ..... 347/43, 19, 29, 347/30, 31, 37, 40, 12, 14, 13, 42

(56) References Cited

U.S. PATENT DOCUMENTS 4,683,481 A 7/1987 Johnson
5,018,884 A * 5/1991 Hirano et al. ..... 347/30
5,278,584 A 1/1994 Keefe et al.
5,428,375 A * 6/1995 Simon et al. ..... 347/12
5,838,343 A * 11/1998 Chapin et al. ..... 347/22
6,095,637 A * 8/2000 Hirabayashi et al. ..... 347/43
6,137,507 A * 10/2000 Inui et al. ..... 347/43
6,543,871 B1 * 4/2003 Rosen et al. ..... 347/15

* cited by examiner

*Primary Examiner*—Lamson Nguyen

(57) ABSTRACT

A printer is disclosed that includes one or more first print bars each having a first printhead carriage, one or more first printhead service stations for servicing each of the first printhead carriages, one or more second print bars each having a second printhead carriage, and one or more second printhead service stations for servicing each of said second printhead carriages. The printer also includes first circuitry for controlling the one or more first print bars and the one or more second print bars such that while the one or more first printhead carriages are being serviced the one or more second print bars are in operation. The printer further includes a second circuitry for recognizing the number of first and second print bars present in the printer and for formatting print jobs to utilize the recognized number of first and second print bars. A second printer having multiple print bars, where each print bar has an array of printheads arranged in a pagewide configuration is also disclosed.

38 Claims, 6 Drawing Sheets

MULTIPLE PRINT BAR APPROACH TO PEN HEALTH AND FIBER MANAGEMENT

BACKGROUND OF THE INVENTION

1. Field of the Invention

The present invention relates to inkjet printing devices. In particular, the present invention relates to a device with multiple printing mechanisms.

2. Discussion of the Background Art

Inkjet printing mechanisms may be used in a variety of different printing devices, such as plotters, facsimile machines and inkjet printers, collectively referred to herein as printers or printer mechanisms. These printers typically use a printhead to shoot drops of ink onto a page or sheet of print media. Some inkjet printers utilize a type of printhead called a cartridge that carries a self contained ink supply back and forth across the media. In the case of a multi-color cartridge, several printheads and reservoirs may be combined into a single unit.

Other inkjet printers, known as "off-axis" systems, propel only a small amount of ink in the printhead across the media, and include a main ink supply in a separate reservoir, which is located "off-axis" from the path of printhead travel. Typically, a flexible conduit or tubing is used to convey the ink from the reservoir to the printhead. A printhead may also have a cap or capping, or cleaning mechanism such that when the printhead is not printing, the printhead is covered. This may serve to prevent the printhead from drying and to protect the printhead from the environment.

Each printhead includes a series of nozzles through which the ink drops are fired. The particular ink ejection mechanism within the printhead includes piezo-electric or thermal printhead technology. Two earlier thermal ink ejection mechanisms are shown in U.S. Pat. Nos. 5,278,584 and 4,683,481, both assigned to the present assignee, Hewlett Packard Company. In a thermal ink ejection mechanism, a barrier layer containing ink channels and vaporization chambers is located between a nozzle orifice plate and a substrate layer. This substrate layer typically contains linear arrays of heating elements, such as resistors, which are energized to heat ink in the vaporization chambers. Upon heating, an ink droplet is ejected from a nozzle associated with the energized resistor.

The nozzles are typically arranged in one or more linear arrays. The linear arrays may be located side-by-side on the printhead, parallel to one another, and substantially perpendicular to the scanning direction. As such, the length of the nozzle arrays defines a print swath or band. That is, if all the nozzles of one array are continually fired as the carriage makes one complete traverse through the print zone, a band or swath of ink appears on the sheet. The height of this band is known as the "swath height" of the printhead, the maximum pattern of ink which can be laid down in a single pass.

The printhead is typically mounted in a carriage that is propelled in a direction orthogonal to the media movement. The carriage may have any number of printheads mounted thereon. To print an image, the carriage is scanned back and forth across above the media in an area known as a print zone. The printhead expels drops of ink as it travels back and forth. By selectively energizing the resistors as the printhead travels, the ink is expelled in a pattern on the media to form a desired image (e.g., a picture, chart or text).

Generally, over time, printers have been developed with an increasing ability to produce more colors, with better resolution, on a larger variety of print media. As inkjet printers are being used in more applications, there is an increasing demand for faster throughput, and an increasing demand for longer print lengths.

Accumulation of fibers on printheads has been an ongoing problem in thermal ink jet printers. Fibers may exist in many forms and may be present in the environment. More typically, fibers are generated by the print media, especially media made of paper or textiles. Fibers can adhere to printheads and cause a print quality defect known as "fiber tracks" in which the fiber becomes wet with Ink and acts like a paint brush on the print media. The resulting artifact is an undesired streak of ink across the printed media.

The traditional solution to this problem is to design the printhead so that the nozzle plate is closer to the printed media than any other feature on the printhead. While advantageous for print quality, this increases the possibility of a short fiber causing fiber tracking. In addition, the design of the "service station" includes features to remove fibers from the printheads. In principle, the combination of a well designed printhead, service station, and printhead cleaning algorithms may mitigate, but not eliminate, problems associated with fibers. This solution is adequate in printing environments where time can be taken to service and wipe the printheads frequently during or in between a print job. However, due to the time needed for this action, the ink deposited before the servicing operation may dry, producing a "banding" appearance. Multi-pass print modes may be implemented to reduce the appearance of "banding," but these may add additional time to a print job. Another solution may be to perform servicing in conjunction with an empty swath. However, for very long print jobs having no empty swaths, there is a high risk of contamination and defects.

Another problem encountered in certain printing applications, for example in the publishing and textile industries, is that additional colors may be required over and above those that can be mixed or synthesized from the traditional high and light dye load primary colors of cyan, magenta and yellow typically found in a color printer. These additional colors are referred to as "spot" colors and are usually pre-formulated with specific properties. In the analog printing systems for the publishing and textile industries, customers have a large range of inks, colors, and options for special configurations. There are hexachrome printers available that add greens or oranges to the primary colors.

In addition, there may be a need to treat the printed media after printing, for example, to apply a fixative or other coating to the finished print job.

Thus, it would be desirable to implement a printing system architecture that provides for faster throughput. It would also be desirable to implement a printing system that prevents the accumulation of fibers on the printhead and eliminates fiber tracks. It would further be desirable to implement a printing system that allows a user to configure and customize spot colors, special treatments or coatings for application during printing.

In a production environment where print speed is essential, the current fiber management techniques require an undesirable amount of time. In the realm of digital textile printing where speed and long runs of potentially fibrous fabrics are used, the present invention is of particular interest and has clear advantages over more traditional systems.

SUMMARY OF THE INVENTION

A printer is disclosed that includes one or more first print bars each having a first printhead carriage, one or more first printhead service stations for servicing each of the first printhead carriages, one or more second print bars each having a second printhead carriage, and one or more second printhead service stations for servicing each of said second printhead carriages. The printer also includes first circuitry for controlling the one or more first print bars and the one or more second print bars such that while the one or more first printhead carriages are being serviced the one or more second print bars are in operation.

The printer also includes circuitry for recognizing the number of print bars and the number of printhead carriages present in the printer and for formatting print jobs to utilize the recognized number of print bars and printhead carriages.

It should be understood that the printer and the printbars are configured such that any number of print bars, preferably two or more, may be installed in the printer. It should also be understood that during periods when no service is required, the printbars may print simultaneously.

The first printhead carriage may include a number of printheads organized in a certain order along a scan axis, and the second printhead carriage may include a number of printheads organized in an order opposite that of the first printhead to mitigate artifacts associated with bi-directional printing. The number of printheads in the first and second printhead carriages may be used to generate print masks. This is advantageous in that a larger population of nozzles are available for use in generating the masks. In addition, by having multiple printhead carriages, uninterrupted printing can occur without interrupting the main servicing of the other print carriages.

In another embodiment of the invention, a printer is disclosed that includes multiple print bars, each having at least two print bars, and at least one printhead service station for servicing the print bars. Each print bar has a plurality of print heads in a page wide configuration. The printer also includes first circuitry for controlling the one or more of the print bars such that while one or more of the print bars are being serviced, at least one other print bar is in operation. By having multiple print bars in page wide configurations, uninterrupted printing can occur without interrupting the main servicing of the other print bars.

Other features and advantages of the present invention include the ability to replace the printhead while the printhead carriage is being serviced, and to automatically align the replaced printhead, the ability to print spot colors and the ability to apply coatings to the print media.

BRIEF DESCRIPTION OF THE DRAWINGS

The above set forth and other features of the present invention are made more apparent in the ensuing Detailed Description of the Invention when read in conjunction with the attached Drawings, wherein.

DETAILED DESCRIPTION OF THE INVENTION

Figure 1:
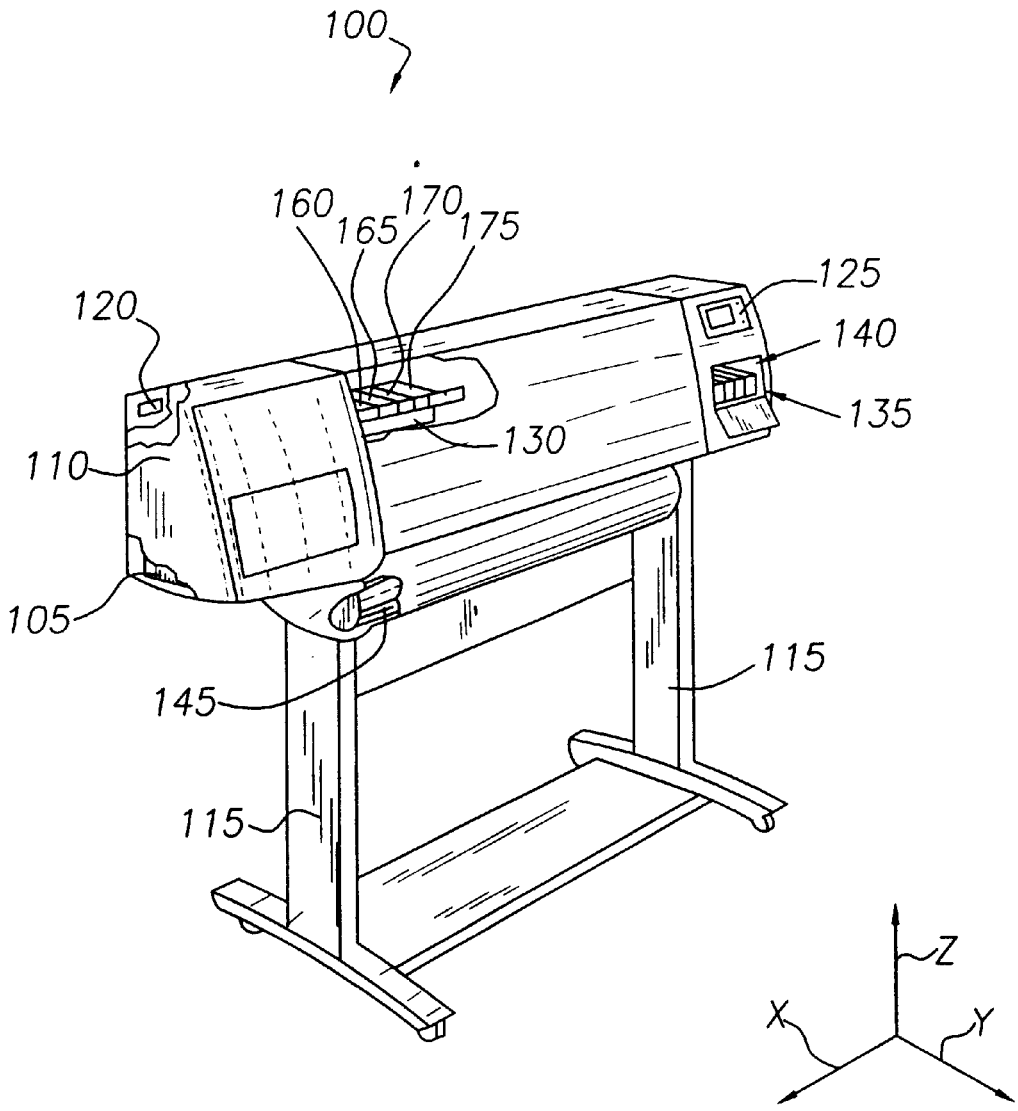
FIG. 1 is a perspective view, in cut-away, of a printer in accordance with the invention.

Referring to the figures and, in particular FIG. 1, there is shown an example of a large format inkjet printer generally represented by reference numeral 100, in accordance with the present invention. Large format printers are usually used for printing conventional engineering and architectural drawings, high quality poster-sized images, intricate patterns on fabric, and other formats using larger size media. They may be utilized in an industrial, office, home, or other environment.

Inkjet printing mechanisms are commercially available in many different types of products. For instance, some of the commercially available products that may embody the present invention include desk top printers, portable printing units, copiers, cameras, video printers, facsimile machines, etc.

The printer 100 includes a chassis 105 surrounded by an enclosure 110. Printer 100 may be supported on a desk or tabletop, but preferably includes a pair of leg assemblies 115. Printer 100 also has a controller, illustrated schematically as processor 120, that receives instructions from a host device, typically a computing device, for example, a personal computer, a mainframe, etc. (not shown).

Printer 100 may also include a key pad and display panel 125, which provides a user interface where the display provides information to a user and the keypad accepts input from the user. A monitor (not shown) connected to the host device may also be used to display visual information to an operator, such as printer status, service requirements, error conditions, etc.

A first printhead carriage 130 is shown that travels reciprocally along an X axis. First printhead carriage 130 carries at least one printhead. However this example of this embodiment includes four printheads 160, 165, 170, 175. As first printhead carriage travels along the X axis, printhead drive circuitry 545, shown in FIG. 5 energizes selected nozzles of the printheads 160, 165, 170, 175, causing them to expel ink, and thus creating images on a print media 145. A first printhead service station 135 is also shown located in a service area 140 along the X axis. During printing operations, print media 145 is advanced along a Y axis, in a direction perpendicular to the first printhead carriage travel. Print media 145 may be any type of suitable sheet material, such as paper, poster board, fabric, transparencies, mylar, etc. First printhead carriage 130 travels over the width of print media 145 and is also capable of traveling over first printhead service station 135.

Figure 2:
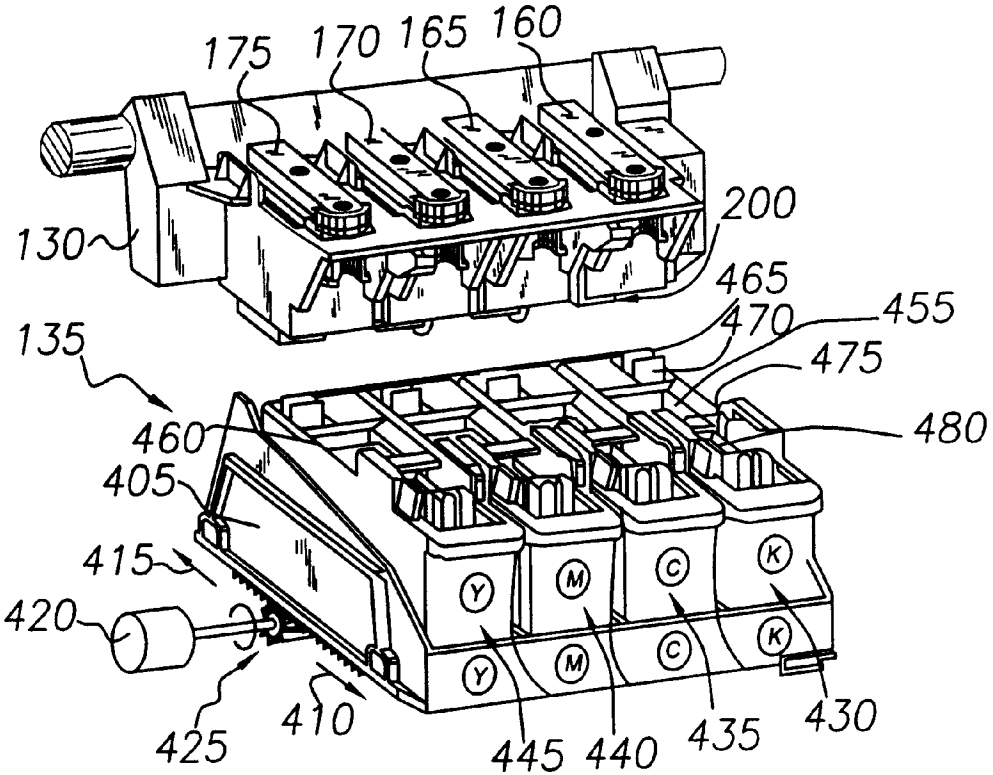
FIG. 2 is a perspective view of a printhead carriage assembly of the printer of FIG. 1 positioned above a printhead service station.

FIG. 2 shows a detailed view of first printhead carriage 130 positioned above first printhead service station 135, located in servicing area 140. First printhead carriage 130 holds at least one printhead. First printhead service station 135 includes a translationally moveable service station pallet 405, which may be driven in both a forward direction 410 and a rearward direction 415. An example of a suitable driving mechanism for first printhead service station 135 may include a motor 420 connected to a rack and pinion gear assembly 425. Motor 420 may drive rack and pinion gear assembly 425 in response to a drive signal received from processor 120. First printhead service station 135 may include a number of printhead cleaner units 430, 435, 440, 445 corresponding to the number of printheads 160, 165, 170, 175. Because each printhead cleaner unit 430, 435, 440, 445 has substantially the same construction, printhead cleaner unit 430 will be described in detail. However, it should be understood that the description also applies to all printhead cleaner units 435, 440, 445.

Printhead cleaner unit 430 includes a spittoon chamber 455. Spittoon chamber 455 may be filled with an ink absorber 460, preferably a foam material, although any suitable absorbing material may be used. In an alternate embodiment, spittoon chamber 455 may be supplied as an empty chamber, which then fills with a tar like ink residue over the life of printhead cleaner unit 430. Printhead cleaner unit 430 may also include a dual bladed wiper assembly, which has two wiper blades 465, 470 preferably constructed with rounded exterior wiping edges and an angular interior wiping edge. Printhead cleaner unit 430 may optionally include an ink solvent chamber (not shown) that holds an ink solvent. To deliver the solvent from the ink solvent chamber to printhead 160, printhead cleaner unit 430 may include a solvent applicator 475.

Printhead cleaner unit 430 may also include a cap member 480 that can move in the Z axis direction. Cap member 480 is also able to tilt between the X and Y axes, which aids in sealing printhead 160. The cap member 480 preferably has an upper surface, which may define a series of channels or troughs, to act as a vent path to prevent depriming printhead 160 upon sealing. The cap member may be made of any suitable cap member material, such as rubber or another compliant material.

By movement of the first printhead service station 135, cap member 480 may seal printhead 160 from the immediate environment. Motor 420 driving rack and pinion gear assembly 425 is used to move first printhead service station 135 in forward direction 410 until spittoon chamber 455 is positioned under printhead 160. In this position, spittoon chamber 455 may receive ink ejected from printhead 160. Motor 420 may move first printhead service station further forward in direction 410 until wiper blades 465, 470 wipe nozzle plate 200 of printhead 160 in order to cleaning nozzle plate 200 and remove any fibers, dried ink, or other contaminants that may have collected thereon.

Figure 3:
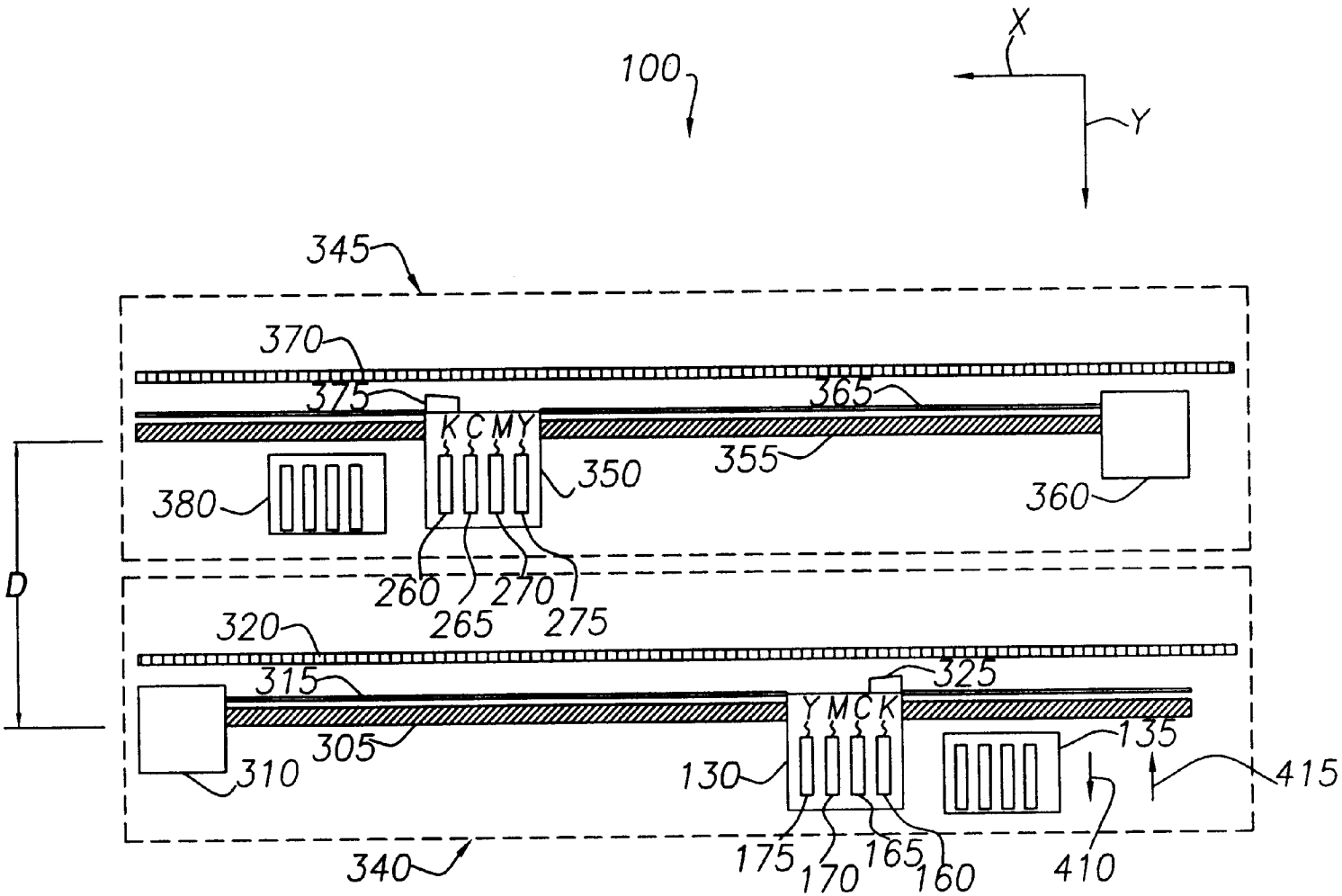
FIG. 3 is a schematic representation of a top view of the printer of FIG. 1 having multiple print bars in accordance with the teachings of the present invention.

Referring to FIG. 3, first printhead carriage 130 is mounted to a first slider bar 305, and connected to a first carriage motor 310 by a first belt 315. First slider bar 305 provides a mounting mechanism for first printhead carriage 130 and a known path on the X axis along which first printhead carriage 130 travels. This path is also referred to as the scan axis. First carriage motor 310 provides force for reciprocally moving first printhead carriage 130 back and forth along first slider bar 305 in response to at least one control signal from processor 120. In the example shown in FIG. 3, force is transferred from first carriage motor 310 to first printhead carriage 130 by first belt 315. A first carriage position indicator may be provided for supplying carriage position information to processor 120. The first carriage position indicator may include a first encoder strip 320, which could extend along the length of printer 100, and may further include a first encoder reader 325 mounted on the back surface of first printhead carriage 130. First encoder reader 325 is positioned to read positional information provided by first encoder strip 320. The manner of providing positional feedback information may also be accomplished using any other suitable apparatus. First printhead service station 135 is preferably located at one side of the printer 100, and positioned to travel in forward direction 410 and rearward direction 415 when it receives a signal to perform service operations.

First printhead carriage 130, first slider bar 305, first carriage motor 310, and first belt 315 are collectively referred to as first print bar 340. First print bar 340 may also include other components, such as first encoder strip 320, first encoder reader 325 and first printhead service station 135.

Printer 100 preferably also includes at least a second print bar 345. Second print bar 345 may include components that are essentially the same as first print bar 340, including a second printhead carriage 350, a second slider bar 355, a second carriage motor 360, and a second belt 365. Second print bar 345 may optionally include a second encoder strip 370, and a second encoder reader 375.

Second print bar 345 preferably also includes a second printhead service station 380 located on a side of printer 100 opposite that of printhead service station 135. Because both first and second printhead service stations 135, 380 travel in forward 410 and rearward 415 direction during servicing, one advantage of having them located at opposite ends of the printer 100 is that less spacing between print bars 340, 345 is required. First print bar 340, second print bar 345, and other print bars that may be present in printer 100 are preferably positioned such that their respective printhead carriages travel along parallel paths along the scan axis that are orthogonal to the direction of media travel or Y axis.

Figure 4:
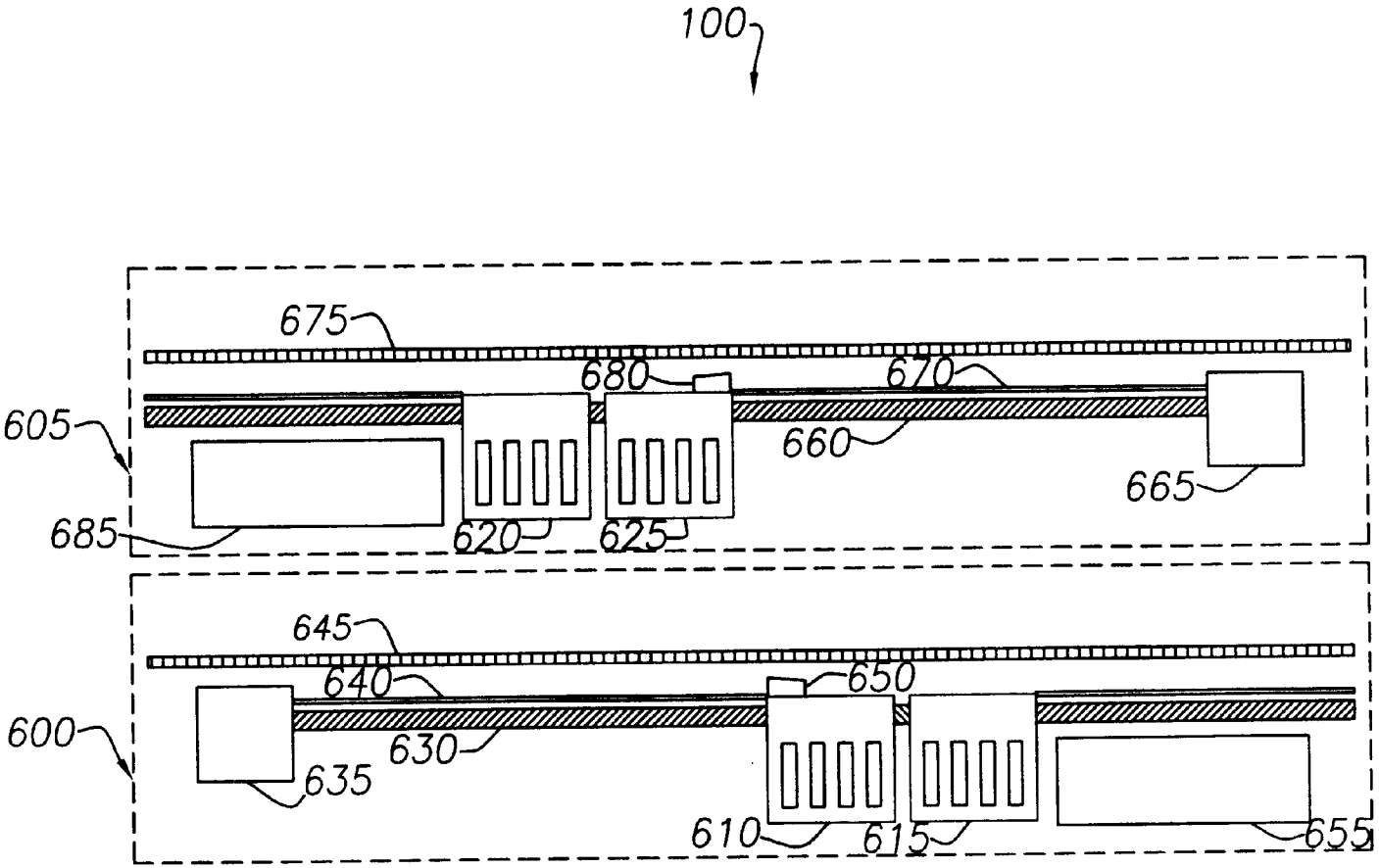
FIG. 4 shows a schematic representation of a top view of a printer having multiple print bars with multiple printhead carriages in accordance with another embodiment of the present invention.

FIG. 4 shows another embodiment of the present invention that uses multiple print bars 600, 605. In FIG. 4, a third print bar 600 includes third and fourth printhead carriages 610, 615 and a fourth print bar 605 includes fifth and sixth printhead carriages 620, 625. Because third print bar 600 includes essentially the same components as fourth print bar 605, only third print bar 600 will be described in detail.

Third and fourth printhead carriages 610, 615 are mounted to a third slider bar 630 and are connected to a third carriage motor 635 by a third belt 640. Third carriage motor 635 provides energy for moving third and fourth printhead carriages 610, 615 along third slider bar 630 in response to one or more control signals from processor 120. Energy is transferred from third carriage motor 635 to third and fourth printhead carriages 610, 615 by third belt 640. Third print bar 630 may also include a third encoder strip 645 that extends along the length of printer 100, and may further include a third encoder reader 650, which may be mounted on either third or fourth printhead carriage 610, 615. Third encoder reader 650 is positioned to read positional information provided by third encoder strip 645. Third printhead service station 655 is positioned toward one side of printer 100, and travels in forward direction 410 and rearward direction 415 under the third and fourth printhead carriages 610, 615 as part of a service operation.

Fourth print bar includes printhead carriages 620, 625 mounted on a fourth slider bar 660. Fourth carriage motor 665 is connected to printhead carriages 620, 625 by a fourth belt 670. A fourth encoder strip 675 may be included that may be read by a fourth encoder reader 680, which may be mounted on either fifth or sixth printhead carriage 610, 615. Fourth printhead service station 675 is positioned toward one side of printer 100.

It should be understood that printer 100 and the print bars included therein may be configured such that any number of print bars may be installed in printer 100 or removed from printer 100 as printing requirements dictate. Thus, the architecture of printer 100 may be scaled according to run length and desired printing completion rate by installation or removal of print bars as required.

It should also be understood that each print bar may include any number of printhead carriages that the particular print bar may be physically capable of accommodating.

Figure 5:
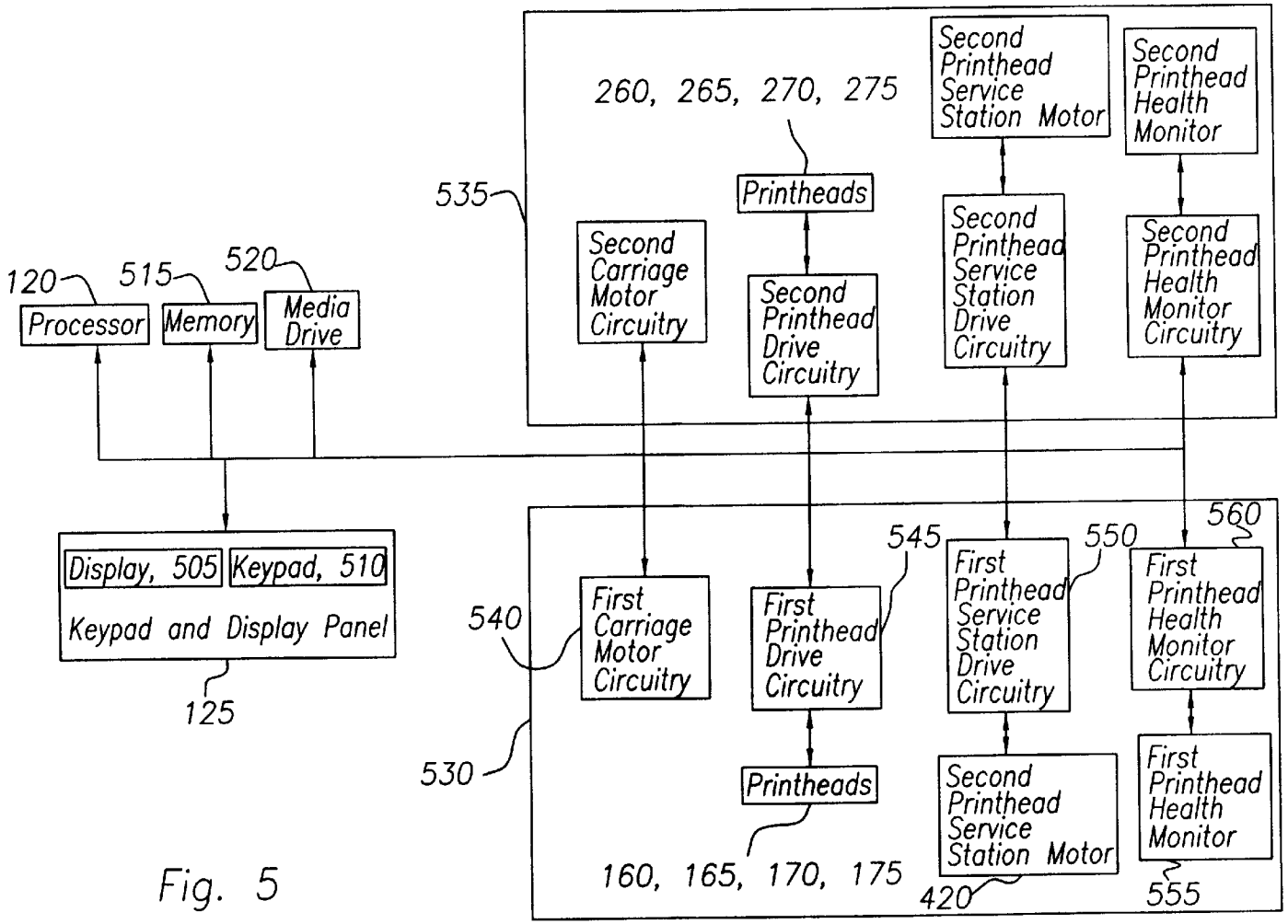
FIG. 5 shows a block diagram of the circuitry of the printers of FIGS. 1 and 4.
Figure 6:
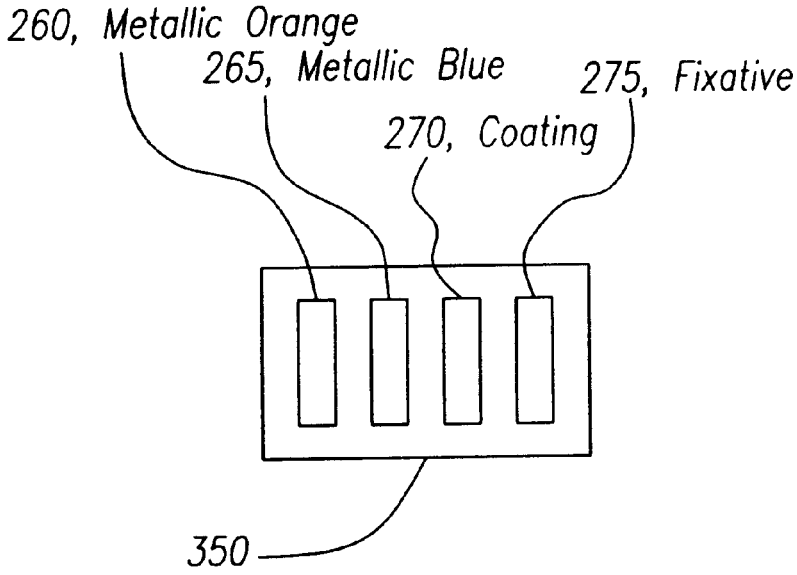
FIG. 6 schematically depicts the printhead carriage of FIG. 2 with printheads for applying spot colors and coatings to print media.

Printer 100 preferably includes all necessary hardware and software components for utilizing the installed printbars for printing. FIG. 5 shows an exemplary schematic block diagram that includes circuitry found in printer 100. Printer 100 includes processor 120 for directing printer operations and keypad and display panel 125 including a display 505 and a keypad 510 for displaying messages to a user and receiving user inputs, respectively. Printer 100 also includes a memory 515 for storing programs, including a printer operating system, temporary system operating parameters and temporary data. Printer 100 also includes a media drive circuitry 520 for advancing print media 145 in either a forward or backward direction along the Y axis.

Processor 120 executes programs in memory 515 either automatically in response to user inputs from keypad and display panel 125, or in response to inputs from the host device. As a part of executing these programs, processor 120 receives printing instructions grouped together known as a print job from the host device. Additionally, the programs executed by processor 120 may include routines for checking the status of various printer components at power up, receiving print jobs, and performing printhead service actions.

The programs resident in memory 515 preferably include routines that allow processor 120 to recognize the presence and number of print bars present in printer 100, and to also recognize the presence and number of printhead carriages present in each print bar. The routines also provide for utilizing the print bars and printhead carriages for printing print jobs.

Printer 100 also includes a circuitry 530 for driving first print bar 340 and a circuitry 535 for driving second print bar 345. Because circuitry 530 is essentially identical to circuitry 535, only circuitry 530 will be described. It should be understood that printer 100 may include circuitry similar to circuitry 530 for each print bar installed, or that the functions performed by various types of circuitry may be combined in any manner, as long as printer 100 is capable of utilizing each installed print bar and printhead carriage. For example, circuitry 530 and circuitry 535 could be branches of the same circuitry.

Circuitry 530 may include a first carriage motor circuitry 540 for driving carriage motor 310, a first printhead drive circuitry 545 for controlling the individual nozzles on each printhead 160, 165, 170, 175 and a first printhead service station drive circuitry 550 for driving printhead service station motor 420. Circuitry 530 may also include a first device for monitoring printhead health 555, and a first circuitry 560 for driving a first monitoring device 555.

Returning now to FIG. 3, one clear advantage of having more than one print bar is an increase in throughput. In one embodiment, both first print head carriage 130 and second printhead carriage 350 may be used simultaneously to print a print job. For example, processor 120 may receive a print job from the host computer. Using programs found in memory 515, processor 120 formats the print job into sections to be printed by each of the print bars 340, 345. The sections may have a dimension along the axis of media travel, that is, the Y axis, that corresponds to the distance D between the printheads of first printhead carriage 130 and second printhead carriage 350. The media drive circuitry 520 then advances print media 145 to the proper position and both print bars begin printing. The individual print bars 340, 345 may print in a unidirectional mode but preferably print in a bi-directional mode. Thus, both print bars 340, 345 are utilized to print the print job simultaneously, resulting in a theoretical doubling of throughput.

Turning to FIG. 4, both third and fourth print bars 600, 605 in combination with third, fourth, fifth, and sixth print head carriages 610, 615, 620, 625 may be used simultaneously for printing. As an example, processor 120 may receive a print job from the host. The processor, directed by programs in memory 515, formats the print job into portions to be printed by each print bar 600, 605 and printhead carriages 610, 615, 620, 625. Print media 145 is moved into position and both print bars 600, 605 may begin printing, each utilizing two printhead carriages 610, 615, and 620, 625, respectively. As with the embodiment of FIG. 3, print bars 600, 605 preferably print in a bi-directional mode. Thus, two print bars 600, 605 incorporating a total of four printhead carriages 610, 615, 620, 625 are utilized to print the print job simultaneously.

Another advantage of embodiments having an even number of print bars is that the printhead carriages 610, 615, 620, 625 may be operated to act as counterweights. A printhead carriage that includes, for example, four printheads (yellow, magenta, cyan, and black) may have a significant mass relative to the printer. In addition, the printhead carriage 610, 615, 620, 625 may travel back and forth at considerable speed, producing undesirable mechanical forces (e.g., vibration), especially when reversing direction. An even number of print bars may be operated so that half the print bars print in one direction along the scan axis, while the other half print in the other direction along the scan axis. This may operate to cancel some of the undesirable mechanical forces. For example, the even number of print bars may be operated so that alternating printbars print in opposite directions.

Returning again to FIG. 3, the printhead carriages 130, 350 include color printheads whose order is reversed. In the example shown, print bar 340 includes, from left to right along the scan axis, yellow printhead (Y) 175, magenta printhead (M) 170, cyan printhead (C) 165, and black printhead (K) 160. Print bar 345 includes, from left to right along the scan axis, black printhead (K) 260, cyan printhead (C) 265, magenta printhead (M) 270, and yellow printhead (Y) 275. The reversed order helps mitigate artifacts associated with bi-directional printing. In order to obtain certain colors, a print bar may have to print an ink drop from more than one printhead onto a single spot or location on print media 145. For example, in order to print a green dot, print bar 340 might have to expel a drop of yellow ink on top of a drop of blue ink. The order of the drops may be critical in determining the color of a particular dot being printed. In addition, the time between the drops may also be important. After a drop has been expelled onto the media it immediately starts to dry. Thus, the time between drops may be critical in determining the amount of color mixing that occurs between different color drops. The reversed order of the printheads in print bar 345 allows it to print the same information as print bar 340, for example, to place colors at a location in a certain order, only in reverse order. For example, a certain pattern may be printed by print bar 340 in a first pass from left to right and a second pass from right to left, while the same information may be printed by print bar 345 in a first pass from right to left and a second pass from left to right. This may be advantageous in that print jobs may be formatted such that each printhead carriage 130, 350 prints during each pass, including while traveling toward their respective printhead service stations 135, 380.

In another embodiment, utilizing a plurality of print bars allows the printer 100 to utilize more flexible error hiding printing patterns or print masks. A print mask may be considered a mapping technique where certain nozzles are used in place of nozzles that are failing or otherwise are in bad health. Because there is more than one print bar available, there may be a larger number of nozzles available for implementing print masks. For example, the number of failing nozzles present in printhead 160 may be so large, or the failures may be grouped together, such that, an insufficient number of healthy nozzles are available as substitutes, thus preventing the effective use of a mask. In some applications, this may result in less than acceptable print job quality. However, the addition of at least one additional print bar provides one or more additional printheads from which to choose substitute nozzles. This allows the printer 100 to implement print masks that may include printheads from more than one carriage to meet the quality requirements of the print job.

In a preferred embodiment, one or more printhead carriages print while others are being serviced. In the example configuration depicted in FIG. 3, first printhead carriage 130 begins printing a print job. Second printhead carriage 350 may also begin printing simultaneously or may begin printing after a delay. When servicing is required, first printhead carriage 130 travels along the X axis from first carriage motor 310 toward first printhead service station 135. Upon arrival at first printhead service station 135, first printhead carriage 130 suspends printing, and is serviced by first printhead service station 135. Service procedures may include capping, wiping, application of solvent, or any other service operation or combination of operations that may be suitable.

While first printhead carriage 130 is being serviced, second printhead carriage 350 continues to print the print job. When servicing is complete, first printhead carriage 130 resumes printing. When second printhead carriage 350 requires service, it travels along the X axis from second carriage motor 360 toward second printhead service station 380. Upon arrival at second printhead service station 380, second printhead carriage 350 suspends printing, and is serviced by second printhead service station 380, while first printhead carriage 135 continues printing. Any unprinted data, already received by the printhead about to be serviced, is routed to another print bar, upstream or downstream, of the print bar being serviced. Therefore, the data stream is adaptable and will not be deleted after a servicing decision has been made.

In this manner, at least one print bar is printing at all times, allowing one printhead carriage to be serviced while the other is printing. In this embodiment each printhead is cleaned regularly and, by alternating which printhead is printing at a given time, continuous printing is assured. Thus, in an environment having a high fiber content, or when utilizing fibrous print media, or under any other conditions that require servicing printhead carriages 130, 350 to the point of impacting throughput, this embodiment may be utilized to minimize or eliminate those adverse effects.

The service procedures may also include printhead replacement if required. In this embodiment it may be desirable to align the new printhead after installation. One method of accomplishing this would be to utilize first printhead health monitor 555 shown in FIG. 5 and to adjust automatically the alignment of the new printhead until the first printhead health monitor 555 provides a desirable output. First printhead health monitor 555 may be a drop detection device, where a drop passes through a light beam impinging on a detector, or a print and scan device, where a pattern is printed and then detected and analyzed, or any other device for detecting parameters related to the ability of a nozzle to suitably expel ink.

As an example, first printhead health monitor may be located near or may be adapted to work with first printhead service station 135. In such a configuration, the new printhead could be directed to fire one or more nozzles into spittoon chamber 455 of first printhead service station 135. The nozzles selected can have a known location when the printhead is aligned. The output of first printhead health monitor 555 could be monitored to determine the locations of the firing nozzles, and the position of the printhead could be automatically adjusted to change the locations to bring the printhead into alignment.

Having more than one print bar also allows for the use of additional printheads having additional colors or other materials to be applied to the print media 145. In a another embodiment, one or more print bars 340, 345 may include printheads for printing spot colors or any other type of special color. As an example, an application may require a color with particular properties that may not be easily duplicated by a combination of yellow, magenta, cyan, and black, or may require a large quantity of a particular color. In both cases, it may be advantageous to provide a printhead specifically for printing that particular color. It is also contemplated that some applications may require multiple printheads for printing spot colors. FIG. 5 shows second printhead carriage 350 where printhead 260 is utilized to print a metallic orange color, and printhead 265 is utilized to print a metallic blue color in accordance with this embodiment. Thus, if a print job requires a spot color, or a number of spot colors, one or more of the print bars may be equipped with a printhead or a number of printheads containing the desired spot colors. The processor 120 is capable of recognizing the printheads containing spot colors and may obtain printing parameters directly from the printhead, or a user may provide the required information through the key board and display.

In some applications, it may also be desirable to apply a material other than ink to print media 145. For example, a particular coating may be applied before or after printing to add a specific characteristic to print media 145 or to the finished print job. For example, a coating may be applied to print media 145 before printing to allow a specially formulated ink to be deposited on print media 145. As another example, a fixative may be applied to a printed area of print media 145 to fix or protect a particular color or printed area. As with the case of spot colors, a specific printhead may be provided for applying the particular coating. FIG. 5 shows an example of printhead carriage 350 configured with a printhead 270 for printing or applying a particular coating and a printhead 275 for printing or applying a fixative.

It is apparent that either first printhead carriage 130, second printhead carriage 345, or any other printhead carriage present in the printer 100 may be configured to print spot colors or apply coatings, and that one or more additional print bars may be added to printer 100 for printing spot colors or for applying various coatings.

In summary, printer 100 is configured to include any number of print bars in various configurations. This allows an increase in throughput over single print bar designs, helps mitigate artifacts associated with bi-directional printing, and allows for more flexibility in providing print masks. In a preferred embodiment, one or more printhead carriages print while others are being serviced, and thus at least one print bar is printing at all times. The invention also provides for printhead replacement during servicing and provides for the use of spot colors and the application of coatings to printed media 145.

Figure 7:
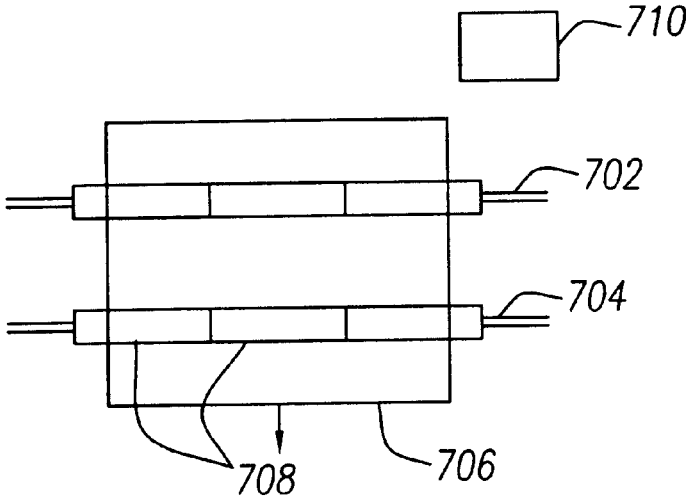
FIG. 7 is a perspective view, in cut-away, of a printer having stationary printheads, each printhead having an array of printheads in a page wide configuration, in accordance with the invention.

Referring now to FIG. 7, in another embodiment of the present invention, printer 700 may be a fixed print head system that includes multiple print bars 702, 704 that are stationary in comparison to the movement of the paper 706. Each print bar 702, 704 includes a plurality of print heads 708 arranged in a page wide configuration. Paper may be moved beneath the print bars 702, 704 and print heads 708 for printing. The print bars 702, 704 remain stationary during printing.

Individual print heads 708, of each print bar, may be moved for servicing to a service station 710. During servicing of a print head 708, the entire print bar 702 may be removed from service. Other print bars are then moved into the printing position in order to continue printing, for example the print bars may be configured to move orthogonal. Any unprinted data will then be transferred to the working print bar 704, for printing.

Printer 700 may be utilized for label printers, envelop printers, and for page wide array (PWA) applications such as copiers and digital presses. In addition, the printheads 708 may include different colors, and the color configuration of the printheads 708 may be reversed between the multiple print bars 702, 704 to allow for multiple color printing.

Printer 700 may be designed to carry multiple print bars and multiple service stations. Multiple circuitry may also be included for controlling the plurality of print bars, plurality of printheads, and/or the plurality of servicing stations. In addition, each print bar may include multiple print heads that are arrayed in a page wide configuration.

It can thus be appreciated that while the present invention has been particularly shown and described with respect to preferred embodiments thereof, it will be understood by those skilled in the art that changes in form and details may be made therein without departing from the scope and spirit of the invention.

We claim:

1. A printer comprising:

a first printhead carriage having a first print bar;

a first printhead service station for servicing said first printhead carriage;

a second printhead carriage having a second print bar;

a second printhead service station for servicing said second printhead carriage; and first circuitry for controlling said first printhead carriage and said second printhead carriage such that while said first printhead carriage is being serviced said second printhead carriage is in operation and that while said second printhead carriage is being serviced said first printhead carriage is in operation.

2. The printer of claim 1, wherein said first and second printhead service stations are located at opposite sides of the printer.

3. The printer of claim 1, further comprising a second circuitry for recognizing the number of said first and second print bars present in the printer and for formatting print jobs to utilize the recognized number of said first and second print bars.

4. The printer of claim 1, wherein said first printhead carriage comprises a plurality of first printhead carriages, and wherein said second printhead carriage comprises a plurality of second printhead carriages.

5. The printer of claim 4, further comprising a third circuitry for recognizing the number of said first print bars and the number of said plurality of first printhead carriages and for recognizing the number of said second print bars and the number of said plurality of second printhead carriages and for formatting print jobs to utilize the recognized number of said first print bars and first printhead carriages and said second print bars and second printhead carriages.

6. The printer of claim 4, wherein each of said plurality of first printhead carriages further comprises a plurality of first printheads organized in a certain order along a scan axis, and each of said plurality of second printhead carriages further comprises a plurality of second printheads organized in an order opposite the order of said first printheads.

7. The printer of claim 6, wherein the plurality of printheads of the second printhead carriage allows the second printhead carriage to print the same information as the first printhead carriage but in opposite order.

8. The printer of claim 4, wherein said plurality of first printhead carriages further comprises a first plurality of printheads and each of said plurality of second printhead carriages further comprises a second plurality of printheads, and wherein the printer further comprises a third circuitry for using each of the first and second plurality of printheads to generate a print mask.

9. The printer of claim 1, further comprising a fifth circuitry that causes said first and second printhead carriages to print simultaneously.

10. The printer of claim 1, further comprising a seventh circuitry that causes said first and second printhead carriages to print in opposite directions.

11. The printer of claim 1, wherein at least one of said first and second printhead carriages includes at least one printhead, and wherein the first circuitry operates to allow a user to replace the at least one printhead while at least one of said first and second printhead carriages is being serviced.

12. The printer of claim 11, further comprising a mechanism for automatically aligning the at least one printhead.

13. The printer of claim 1, wherein when servicing of said first printhead carriages is complete, the first circuitry causes said first printbar to resume operation.

14. The printer of claim 1, wherein at least one of said first and second printhead carriages includes a printhead having a color with properties that are not duplicatable from a combination of yellow, magenta, cyan, and black ink.

15. The printer of claim 1, wherein at least one of said first and second printhead carriages includes a printhead having a spot color.

16. The printer of claim 1, wherein at least one of said first and second printhead carriages includes a printhead having a coating to be applied to a print media.

17. The printer of claim 1, further comprising:

a third printhead carriage having a third print bar; and a third printhead service station for servicing said third printhead carriage, wherein the first circuitry controls said first, second, and third print bars such that while said first printhead carriage is being serviced, said second and third print bars remain in operation.

18. The printer of claim 17, further comprising:

a fourth printhead carriage having a fourth print bar; and a fourth printhead service station for servicing each said fourth printhead carriage, wherein the first circuitry controls said first, second, third, and fourth print bars such that while said first printhead carriage is being serviced, said second, third, and fourth print bars remain in operation.

19. The printer of claim 1, wherein each of said print bars comprise a plurality of printhead carriages, said printhead carriages arranged in a page wide configuration.

20. A printer comprising:

a first printhead carriage having a first print bar;

a second printhead carriage having a second print bar;

first circuitry for controlling the first print bar and the second print bar such that the first print bar and the second print bar print bi-directionally whereby printing throughput is increased;

a first printhead service station for servicing said first printhead carriage; and a second printhead service station for servicing said second printhead carriage, wherein the first circuitry controls the first print bar and the second print bar such that while said first printhead carriage is being serviced the second printhead carriage is in operation and while the second printhead carriage is being serviced the first printhead carriage is in operation.

21. The printer of claim 20, wherein the first and second printhead service stations are located at opposite sides of the printer.

22. The printer of claim 20, wherein said first and second printhead carriages includes at least one printhead, and wherein the first circuitry operates to allow a user to replace a printhead while at least one of said first and second printhead carriages is being serviced.

23. The printer of claim 22, wherein the working printhead is located upstream or downstream of the serviced printhead.

24. The printer of claim 22, further comprising a mechanism for automatically aligning the printhead.

25. The printer of claim 20, wherein the printhead being serviced routes unprinted data to a working printhead.

26. The printer of claim 20, wherein when servicing the one or more first printhead carriages is complete, the first circuitry causes the first printbar to resume operation.

27. The printer of claim 20, wherein when said second printhead carriage requires service, the first circuitry cause said second printhead carriage to be serviced while the first print bar is in operation.

28. The printer of claim 20, further comprising a second circuitry for recognizing the number of first and second print bars present in the printer and for formatting print jobs to utilize the recognized number of print bars.

29. The printer of claim 20, wherein said first printhead carriage comprises a plurality of first printhead carriages, wherein and said second printhead carriage comprises a plurality of second printhead carriages.

30. The printer of claim 29, further comprising a third circuitry for recognizing the number of first print bars and the number of said plurality of first printhead carriages and for recognizing the number of second print bars and the number of said plurality of second printhead carriages and for formatting print jobs to utilize the recognized number of first print bars and first printhead carriages and second print bars and second printhead carriages.

31. The printer of claim 29, wherein each of said plurality of first printhead carriages further comprises a plurality of first printheads organized in a certain order along a scan axis, and each of said plurality of second printhead carriages further comprises a plurality of second printheads organized in an order opposite the certain order of the first printheads.

32. The printer of claim 31, wherein said plurality of printheads of said plurality of second printhead carriages allows said plurality of second printhead carriages to print the same information as said plurality of first printhead carriages but in opposite order.

33. The printer of claim 20, wherein each of said plurality of first printhead carriages further comprises a first plurality of printheads and each of said plurality of second printhead carriages further comprises a second plurality of printheads, and wherein the printer further comprises a fourth circuitry for using each of said first and second plurality of printheads to generate a print mask.

34. The printer of claim 20, further comprising a fifth circuitry that causes said plurality of first and second printhead carriages to print simultaneously.

35. The printer of claim 20, further comprising a seventh circuitry that causes said plurality of first and second printhead carriages to print in opposite directions.

36. The printer of claim 20, wherein at least one of said plurality of first and second printhead carriages includes at least one printhead having a color with properties that are not duplicatable from a combination of yellow, magenta, cyan, and black ink.

37. The printer of claim 20, wherein at least one of said plurality of first and second printhead carriages includes a printhead having a spot color.

38. The printer of claim 20, wherein at least one of said plurality of first and second printhead carriages includes a printhead having a coating to be applied to a print media.

* * * * *